US011325235B2

(12) United States Patent
Meyer et al.

(10) Patent No.: US 11,325,235 B2
(45) Date of Patent: May 10, 2022

(54) PUSH-ON SUPPORT MEMBER FOR FASTENING TOOLS

(71) Applicant: BLACK & DECKER INC., New Britain, CT (US)

(72) Inventors: Jeffrey J. Meyer, Baltimore, MD (US); Stuart E. Garber, Towson, MD (US); Erin Elizabeth Jaskot, Richmond, VA (US)

(73) Assignee: Black & Decker, Inc., New Britain, CT (US)

( * ) Notice: Subject to any disclaimer, the term of this patent is extended or adjusted under 35 U.S.C. 154(b) by 237 days.

(21) Appl. No.: 15/195,095

(22) Filed: Jun. 28, 2016

(65) Prior Publication Data

US 2017/0368672 A1 Dec. 28, 2017

(51) Int. Cl.
*B25C 7/00* (2006.01)
*B25C 1/06* (2006.01)

(52) U.S. Cl.
CPC . *B25C 7/00* (2013.01); *B25C 1/06* (2013.01)

(58) Field of Classification Search
CPC ..... B25C 5/1686; B25C 1/006; B25C 7/00
USPC .... 227/148, 8, 129, 140, 147, 151, 119, 156
See application file for complete search history.

(56) References Cited

U.S. PATENT DOCUMENTS 1,526,025 A 2/1925 Street
1,988,827 A * 1/1935 Bennett ..... B23K 3/0338 219/236
2,594,605 A * 4/1952 Zoppelt ..... A47H 1/022 211/123
2,745,689 A * 5/1956 Balint ..... G05G 1/12 403/357
2,822,698 A 2/1958 Gross
2,979,725 A 4/1961 Wandel et al.
3,172,124 A 3/1965 Kremiller
3,225,443 A * 12/1965 Young ..... B25D 17/28 30/273
3,480,210 A * 11/1969 Perrinjaquet ..... A63F 9/14 238/10 R
3,563,438 A 2/1971 Doyle et al.
3,570,739 A 3/1971 Volkmann et al.
3,603,281 A * 9/1971 Froelich ..... G06M 1/062 116/299
3,658,229 A 4/1972 Pomeroy
(Continued)

FOREIGN PATENT DOCUMENTS

DE 29917830 U1 10/1999
EP 218778 B1 11/1990
(Continued)

OTHER PUBLICATIONS

EP Search Report, dated Jan. 4, 2018.
(Continued)

*Primary Examiner* — Robert F Long
(74) *Attorney, Agent, or Firm* — Rhonda Barton

(57) ABSTRACT

A fastening tool of the present invention includes a housing having an underside. The fastening tool also includes a magazine and a support foot connected to one of the housing underside and the magazine. Using a system of cooperating detents formed on the support foot and housing underside (or magazine, as the case may be), the support foot can be quickly and easily removably secured to the fastening tool without using any tools.

12 Claims, 13 Drawing Sheets

(56) References Cited

U.S. PATENT DOCUMENTS 3,659,768 A 5/1972 Brunelle
3,743,159 A 7/1973 Schneider
3,765,588 A 10/1973 Frederickson
3,767,114 A * 10/1973 Rossi ..... A63H 19/30 238/10 E
3,768,846 A * 10/1973 Hensley ..... F16B 5/0607 52/127.5
3,774,293 A 11/1973 Golsch
3,820,705 A 6/1974 Beals
3,827,822 A * 8/1974 Converse ..... B25H 1/0078 173/31
3,890,058 A * 6/1975 Self ..... B25H 1/0078 408/112
3,893,610 A 7/1975 Smith
3,979,040 A 9/1976 Denin
4,033,499 A 7/1977 Butler
4,049,181 A 9/1977 Kametaki
4,129,240 A 12/1978 Geist
4,186,862 A 2/1980 Klaus
4,197,974 A 4/1980 Morton et al.
4,230,249 A * 10/1980 Nasiatka ..... B25C 5/06 173/202
4,270,587 A * 6/1981 Ludy ..... B25D 1/04 81/23
4,270,687 A 6/1981 Maurer
4,304,349 A 12/1981 Novak et al.
4,313,552 A 2/1982 Maurer
4,314,782 A * 2/1982 Beekenkamp ..... B25H 1/005 408/110
4,316,513 A 2/1982 Harris
4,375,867 A * 3/1983 Novak ..... B25C 1/005 227/109
4,389,012 A 6/1983 Grikis et al.
4,403,725 A 9/1983 Lawrence
4,404,894 A 9/1983 Oesterle
4,416,172 A 11/1983 Medinger
4,424,929 A 1/1984 Weis
4,468,159 A * 8/1984 Oster ..... B23Q 11/1007 125/20
4,485,952 A 12/1984 Weis
4,487,355 A 12/1984 Ginnow et al.
4,519,535 A 5/1985 Crutcher
4,558,811 A 12/1985 Klaus
4,566,621 A 1/1986 Becht
4,597,517 A 7/1986 Wagdy
4,667,747 A 5/1987 Falls et al.
4,749,115 A * 6/1988 Fehrs ..... B25C 5/1651 227/109
4,765,786 A * 8/1988 Krogh ..... B23B 47/28 408/110
4,807,793 A 2/1989 Ghibely
4,810,137 A * 3/1989 Yang ..... B25H 1/0042 408/100
4,834,342 A 5/1989 Padgett
4,854,393 A * 8/1989 Palet ..... B23Q 11/0858 173/62
4,863,089 A 9/1989 McCardle et al.
4,912,848 A * 4/1990 Bidanset ..... B27B 17/0008 173/162.2
4,967,623 A 11/1990 Jackson
5,025,968 A 6/1991 Nasiatka
5,074,453 A 12/1991 Tachihara et al.
5,134,812 A * 8/1992 Hoffman ..... F16B 1/0014 403/305
5,165,827 A * 11/1992 Miller ..... B25H 1/0042 408/110
5,192,012 A 3/1993 Schafer et al.
5,261,588 A 11/1993 Lin
5,297,886 A * 3/1994 Jansen ..... F16B 7/0413 403/232.1
5,368,213 A 11/1994 Massari
5,405,071 A * 4/1995 Baugus ..... B25C 1/047 227/140
5,445,479 A * 8/1995 Hillinger ..... B25F 5/00 16/430
5,462,127 A * 10/1995 Svensson ..... B25D 17/24 173/162.1
5,478,002 A 12/1995 Clement et al.
5,484,094 A 1/1996 Gupta
5,495,973 A 3/1996 Ishizawa et al.
5,575,051 A 11/1996 Moore
5,588,577 A 12/1996 Chen
5,647,525 A 7/1997 Ishizawa
5,649,661 A 7/1997 Masuno et al.
5,683,024 A 11/1997 Eminger et al.
5,695,108 A 12/1997 Lee
5,711,471 A 1/1998 White
5,779,145 A * 7/1998 Zelle ..... A63H 19/30 238/10 C
5,813,588 A 9/1998 Lin
5,816,468 A 10/1998 Yang
5,831,817 A * 11/1998 Chang ..... G06F 1/16 361/679.07
5,921,562 A 7/1999 Robison
5,931,364 A 8/1999 Dennis
6,036,072 A 3/2000 Lee
6,053,389 A 4/2000 Chu et al.
6,056,181 A 5/2000 Chuang
6,112,831 A * 9/2000 Gustafsson ..... B25D 17/043 173/162.2
6,131,787 A 10/2000 Curtis
6,145,723 A 11/2000 Gupta
6,149,046 A 11/2000 Ho et al.
6,161,744 A 12/2000 Mukoyama et al.
6,199,739 B1 3/2001 Mukoyama et al.
6,308,879 B1 10/2001 Wang
6,364,192 B1 4/2002 Lin
6,371,348 B1 4/2002 Canlas et al.
6,394,332 B2 5/2002 Akiba
6,431,428 B1 8/2002 Chen
6,557,743 B2 5/2003 Schuster
6,585,142 B1 7/2003 Chen
6,598,775 B1 7/2003 Chen
6,598,777 B2 7/2003 Osuga et al.
6,641,018 B2 11/2003 Akiba
6,672,497 B2 1/2004 Lin
6,691,907 B1 2/2004 Chang
6,769,591 B2 8/2004 Yamamoto et al.
6,789,718 B2 9/2004 Canlas et al.
6,796,475 B2 9/2004 Adams
6,805,272 B1 10/2004 Sen-Mu et al.
D498,127 S 11/2004 Leasure
6,814,156 B2 * 11/2004 Dieterle ..... B25F 5/026 16/110.1
6,908,021 B1 6/2005 Wang
6,913,180 B2 7/2005 Schuster
6,918,527 B2 7/2005 Hakozaki et al.
D509,418 S 9/2005 Leasure
6,948,647 B1 9/2005 Niblett et al.
6,966,477 B1 11/2005 Chien-Kuo et al.
6,971,567 B1 12/2005 Cannaliato et al.
6,974,061 B2 12/2005 Adams et al.
6,974,062 B2 12/2005 Akiba
6,978,920 B2 12/2005 Hamada et al.
7,000,294 B2 2/2006 Kakuda et al.
D520,839 S 5/2006 Miwa
7,055,728 B2 6/2006 Lin
7,086,573 B1 8/2006 Wen
7,100,475 B1 9/2006 Rufolo, Jr.
7,134,586 B2 11/2006 McGee et al.
7,138,595 B2 11/2006 Berry et al.
7,140,524 B2 11/2006 Hung et al.
7,143,921 B2 12/2006 Hakozaki et al.
7,165,305 B2 1/2007 Kenney et al.
7,204,403 B2 4/2007 Kenney et al.
7,210,607 B2 5/2007 Niblett et al.
D551,931 S 10/2007 Leasure
7,285,877 B2 10/2007 Gorti et al.
D556,003 S 11/2007 Buck
7,303,103 B2 12/2007 Wang
7,322,506 B2 1/2008 Forster
D562,664 S 2/2008 Buck

(56) References Cited

U.S. PATENT DOCUMENTS 7,328,826 B2 2/2008 Shkolnikov
7,331,403 B2 2/2008 Berry et al.
7,410,084 B1 8/2008 Reed
7,413,103 B1 8/2008 Ho et al.
7,451,735 B2 * 11/2008 Riley ..... B29C 45/14467 123/195 C
7,469,811 B2 12/2008 Shima et al.
7,470,081 B2 * 12/2008 Miyahara ..... F16B 21/075 403/221
7,484,647 B2 2/2009 Yang
7,494,036 B2 2/2009 Shima et al.
7,497,058 B2 * 3/2009 Martensson ..... E04B 1/6129 52/582.1
7,503,401 B2 3/2009 Gross et al.
7,506,787 B2 3/2009 Wu et al.
7,513,402 B2 4/2009 Miyashita et al.
7,516,532 B2 4/2009 Wojcicki
7,547,167 B2 * 6/2009 Baber ..... B25F 5/029 409/182
7,552,852 B2 6/2009 Haskins et al.
7,556,184 B2 7/2009 Brendel et al.
7,559,447 B2 7/2009 Chen et al.
7,571,844 B2 8/2009 Bromley et al.
7,575,140 B2 8/2009 Jiang
7,575,141 B1 8/2009 Liang et al.
7,575,142 B2 8/2009 Liang et al.
7,637,408 B2 12/2009 Takahashi et al.
7,654,430 B2 2/2010 Cho et al.
7,686,199 B2 3/2010 Gross et al.
7,690,546 B2 4/2010 Cortez
7,726,536 B2 6/2010 Gross et al.
7,748,588 B2 7/2010 Osuga et al.
7,762,443 B2 7/2010 Tamura et al.
7,788,997 B2 9/2010 Kozak et al.
7,789,169 B2 9/2010 Berry et al.
7,870,987 B1 1/2011 Zhang et al.
7,874,469 B2 1/2011 Liu
7,905,377 B2 3/2011 Krondorfer et al.
7,934,565 B2 5/2011 Krondorfer et al.
7,934,566 B2 5/2011 Hlinka
7,959,049 B2 6/2011 Dittrich et al.
7,975,893 B2 7/2011 Berry et al.
7,980,439 B2 7/2011 Akiba et al.
7,980,441 B2 7/2011 Dittrich et al.
7,997,467 B2 8/2011 Hirabayashi et al.
8,011,441 B2 9/2011 Leimbach et al.
8,011,547 B2 9/2011 Leimbach et al.
8,011,549 B2 9/2011 Berry et al.
8,025,197 B2 9/2011 Brendel et al.
8,042,717 B2 10/2011 Lam et al.
RE42,987 E 12/2011 Akiba
8,091,752 B2 1/2012 Jian et al.
8,104,658 B2 1/2012 Yu
8,123,099 B2 2/2012 Kenney et al.
8,136,606 B2 3/2012 Krondorfer et al.
8,167,182 B2 5/2012 Shima et al.
8,230,941 B2 7/2012 Leimbach et al.
8,231,039 B2 7/2012 Buck et al.
8,240,534 B2 8/2012 Hirabayashi
8,256,528 B2 * 9/2012 Oesterle ..... B25F 5/026 173/162.1
8,267,296 B2 9/2012 Leimbach et al.
8,267,297 B2 9/2012 Leimbach et al.
8,286,722 B2 10/2012 Leimbach et al.
8,292,143 B2 10/2012 Lee et al.
8,302,833 B2 11/2012 Gross et al.
8,313,012 B2 11/2012 Shima et al.
8,347,978 B2 1/2013 Forster et al.
8,381,830 B2 2/2013 Puzio et al.
8,387,718 B2 3/2013 Leimbach et al.
8,408,327 B2 4/2013 Forster et al.
8,434,566 B2 5/2013 Forster et al.
8,439,242 B2 5/2013 Tanji et al.
8,505,798 B2 8/2013 Simonelli et al.
8,534,527 B2 9/2013 Brendel et al.
8,602,282 B2 12/2013 Leimbach et al.
8,777,081 B2 7/2014 Chen et al.
8,997,744 B2 * 4/2015 Ho ..... A61M 16/06 128/205.25
9,120,028 B2 * 9/2015 Wilson ..... A63H 33/062
9,126,319 B2 9/2015 Gross et al.
9,346,156 B1 5/2016 Fago
9,346,158 B2 5/2016 Garber et al.
9,399,281 B2 7/2016 Brendel et al.
9,459,075 B1 * 10/2016 Hatcher ..... F41G 1/48
9,577,493 B2 2/2017 Ekstrom et al.
9,643,200 B2 * 5/2017 Belanger ..... B05B 11/048
10,926,385 B2 * 2/2021 Myers ..... B25C 1/008
10,987,790 B2 * 4/2021 Garber ..... B25C 1/06
2001/0038026 A1 * 11/2001 Dickhaut ..... B25C 7/00 227/148
2002/0104866 A1 8/2002 Miller et al.
2002/0117532 A1 8/2002 Miller et al.
2002/0174807 A1 * 11/2002 Mason ..... B65D 19/0002 108/51.11
2002/0185514 A1 12/2002 Adams et al.
2003/0038786 A1 * 2/2003 Nguyen ..... G06F 1/1624 345/169
2003/0146262 A1 8/2003 Hwang et al.
2003/0230622 A1 12/2003 Rotharmel
2004/0169057 A1 9/2004 Ronconi
2004/0222266 A1 11/2004 Kakuda et al.
2005/0166713 A1 8/2005 Lloyd
2005/0217416 A1 10/2005 Berry et al.
2005/0220445 A1 10/2005 Baskar et al.
2005/0242152 A1 11/2005 Ronconi
2006/0102685 A1 5/2006 Phillips et al.
2006/0231582 A1 10/2006 Hong et al.
2006/0248998 A1 * 11/2006 Duginske ..... B23Q 3/007 83/468
2006/0272269 A1 * 12/2006 Bannister ..... E04F 19/02 52/718.01
2006/0273131 A1 12/2006 Chen
2007/0045345 A1 * 3/2007 Monfeli ..... B05C 17/00526 222/173
2007/0090148 A1 * 4/2007 Cho ..... B25C 5/1658 227/137
2007/0102471 A1 5/2007 Gross et al.
2007/0261868 A1 11/2007 Gross
2008/0099525 A1 5/2008 Brendel et al.
2008/0135596 A1 6/2008 Wu et al.
2008/0223894 A1 9/2008 Cruise et al.
2008/0283568 A1 11/2008 Nayrac et al.
2008/0290128 A1 * 11/2008 Buetow ..... B25C 7/00 227/8
2008/0296340 A1 12/2008 Wang
2009/0050668 A1 2/2009 Jian
2009/0084824 A1 * 4/2009 Jiang ..... B25C 5/16 227/110
2009/0108046 A1 4/2009 Huang
2009/0120281 A1 5/2009 Yang
2009/0145520 A1 * 6/2009 Opsitos, Jr. ..... B23B 45/02 144/108
2009/0152323 A1 * 6/2009 Lin ..... B25C 7/00 227/148
2009/0266867 A1 * 10/2009 Mina ..... B25C 7/00 227/151
2010/0057014 A1 3/2010 Cane
2010/0116863 A1 5/2010 Suda
2010/0301091 A1 12/2010 Liang et al.
2010/0308098 A1 * 12/2010 Francis ..... B25C 7/00 227/148
2011/0057014 A1 3/2011 Yang et al.
2011/0114692 A1 5/2011 Liang et al.
2011/0132959 A1 6/2011 Hlinka et al.
2011/0198381 A1 8/2011 McCardle et al.
2011/0215131 A1 9/2011 Liang
2011/0278342 A1 11/2011 Kuo
2011/0315414 A1 12/2011 Kuntner et al.
2011/0315840 A1 12/2011 Connolly et al.
2012/0074194 A1 3/2012 Miller et al.
2012/0187177 A1 7/2012 Myburgh et al.

(56) References Cited

U.S. PATENT DOCUMENTS

| | | | | |
|---|---|---|---|---|
| 2013/0029548 | A1 | 1/2013 | Stenzel et al. | |
| 2013/0153254 | A1 | 6/2013 | Liang et al. | |
| 2013/0227869 | A1 | 9/2013 | Thordsen | |
| 2013/0240299 | A1 | 9/2013 | Jagdale et al. | |
| 2013/0306699 | A1 | 11/2013 | Baskar et al. | |
| 2013/0320059 | A1 | 12/2013 | Gregory et al. | |
| 2013/0320060 | A1 | 12/2013 | Gregory et al. | |
| 2013/0320063 | A1 | 12/2013 | Gregory et al. | |
| 2013/0320064 | A1 | 12/2013 | Gregory et al. | |
| 2013/0320065 | A1 | 12/2013 | Gregory et al. | |
| 2013/0320066 | A1 | 12/2013 | Gregory et al. | |
| 2013/0320067 | A1 | 12/2013 | Gregory et al. | |
| 2013/0320068 | A1 | 12/2013 | Gregory et al. | |
| 2014/0069671 | A1 | 3/2014 | Leimbach et al. | |
| 2014/0097223 | A1 | 4/2014 | Baron et al. | |
| 2014/0158739 | A1 | 6/2014 | Grazioli et al. | |
| 2014/0325886 | A1 | 11/2014 | Mather | |
| 2014/0361066 | A1 | 12/2014 | Liu et al. | |
| 2014/0373329 | A1 | 12/2014 | Volfson | |
| 2015/0096776 | A1 | 4/2015 | Garber | |
| 2015/0122867 | A1 | 5/2015 | Segura | |
| 2015/0352702 | A1 | 12/2015 | Chien | |
| 2016/0129573 | A1* | 5/2016 | Anstett | E04F 21/22 227/148 |
| 2017/0066116 | A1 | 3/2017 | Garber et al. | |
| 2017/0232600 | A1* | 8/2017 | King, Jr. | B25D 17/28 173/1 |
| 2018/0001454 | A1 | 1/2018 | Jaskot et al. | |
| 2018/0001456 | A1 | 1/2018 | Garber | |
| 2018/0015600 | A1 | 1/2018 | Akiba | |
| 2018/0099400 | A1* | 4/2018 | Wong | B25C 1/00 |
| 2018/0154509 | A1* | 6/2018 | Sergyeyenko | B25F 5/029 |
| 2018/0281840 | A1 | 10/2018 | Yoon et al. | |
| 2018/0333888 | A1 | 11/2018 | Bauer et al. | |
| 2019/0091844 | A1 | 3/2019 | Akiba | |
| 2019/0224832 | A1* | 7/2019 | Watanabe | F02B 63/02 |
| 2019/0299380 | A1 | 10/2019 | Meyer et al. | |

FOREIGN PATENT DOCUMENTS

| | | | |
|---|---|---|---|
| EP | 931625 | A2 | 7/1999 |
| EP | 1206337 | A2 | 5/2002 |
| EP | 1207017 | B1 | 8/2006 |
| EP | 1798003 | A1 | 6/2007 |
| EP | 1884322 | A1 | 2/2008 |
| EP | 2105258 | A2 | 9/2009 |
| EP | 2105259 | A2 | 9/2009 |
| EP | 1795305 | B1 | 2/2010 |
| EP | 1864759 | B1 | 10/2010 |
| EP | 2065137 | B1 | 11/2011 |
| EP | 2441552 | A2 | 4/2012 |
| EP | 2687334 | | 1/2014 |
| EP | 2711135 | B1 | 7/2016 |
| EP | 2301718 | B1 | 12/2016 |
| GB | 602455 | A | 5/1948 |
| JP | S5499276 | A | 8/1979 |
| JP | H06246649 | A | 9/1994 |
| JP | 2000354981 | A | 12/2000 |
| JP | 2002210676 | A | 7/2002 |
| WO | 2009/046076 | A1 | 4/2009 |
| WO | 2015164032 | A1 | 10/2015 |

OTHER PUBLICATIONS

International Search Report and Written Opinion dated Nov. 2, 2017 in corresponding International Patent Application No. PCT/US2017/039988.

Office Action in corresponding European Patent Application No. 17737706.6 dated Feb. 13, 2020.

International Search Report and Written Opinion dated Oct. 12, 2017 in corresponding International Patent Application No. PCT/US2017/039981.

Extended European Search Report dated Mar. 28, 2018 in corresponding U.S. Appl. No. 15/195,057.

Extended European Search Report dated Mar. 29, 2018 in corresponding U.S. Appl. No. 15/196,175.

Extended European Search Report dated Nov. 20, 2017 in corresponding U.S. Appl. No. 15/629,871.

Copenheaver, Blaine R.—International Search Report and Written Opinion re: related application No. PCT/US2017/039723—dated Sep. 6, 2017—7 pages.

Extended European Search Report, dated Jan. 28, 2020 in corresponding U.S. Appl. No. 15/637,720.

Extended European Search Report, Dec. 3, 2018 in corresponding U.S. Appl. No. 15/899,530.

Hilti DX460—at least as early as Mar. 17, 2016.

Hilti DX351—at least as early as Mar. 17, 2016.

Ramset XT540—at least as early as Mar. 17, 2016.

Hilti GX120—at least as early as Mar. 17, 2016.

Simpson GCN-MEPMAG—at least as early as Mar. 17, 2016.

Ramset Trackfast—at least as early as Mar. 17, 2016.

T3 Ramset—at least as early as Mar. 17, 2016.

Hilti GX2—at least as early as Mar. 17, 2016.

Office Action in corresponding European Patent Application No. 17737194.5 dated Feb. 13, 2020.

* cited by examiner

PUSH-ON SUPPORT MEMBER FOR FASTENING TOOLS

BACKGROUND OF THE INVENTION

Field of the Invention

The present invention relates to fastening tools, and more particularly to fastening tools having support elements to orient the fastening tools to a work surface.

Description of the Related Art

Fastening tools, such as concrete nailers, staplers and other nailers, are often equipped with various support elements to orient the fastening tools relative to a work surface. Typically the support elements are mounted on the bottom of the fastening tool magazine or on the bottom of the fastening tool housing. Some support elements are made adjustable on the fastening tool so that the fastener drive axis can be oriented at one of several different angles relative to the work surface. Others are permanently attached to a fixed location on the fastening tool, thereby yielding much less flexibility.

One major difficulty with conventional adjustable types of support elements is that they require such tools as screwdrivers and wrenches, first to remove the support element, then to move the support element from one location on the fastening tool to another, and then finally to reattach the support element to the fastening tool. That means every time it's necessary to readjust the angle of the fastening tool drive axis relative to a work surface, the operator must first reach for the necessary screwdriver or wrench, then use that tool to release the support element from, then reattach the support element to, the fastening tool. As may be imagined, the above sequence costs a considerable amount of time.

Another drawback to conventional removable support elements is that such elements involve multi-part, often elaborate, subassemblies, including, for example, swiveling mechanisms. Swiveling mechanisms necessarily make support elements more expensive and more likely to malfunction, than if it were possible to manufacture the support elements as one-piece units.

Thus, it has become apparent that what is now required is a fastening tool equipped with a removable one-piece support member or foot which requires no tools either to connect the support member to the fastening tool, or to secure the support member in place.

SUMMARY OF THE INVENTION

Accordingly, one embodiment of the fastening tool of the present invention includes a one-piece adjustable support member or foot which can be removably attached either directly to the underside of the fastening tool, or to a fastener magazine disposed on the underside of the fastening tool, without using any tools. The support foot defines internal channels or slots which, in turn, define female detents. The channels cooperate with mating tracks or rails disposed on either the underside of the fastening tool or on the bottom of a fastener magazine, as the case may be. The tracks define male detents which cooperate with the female detents to releasably but securely retain the support foot on the fastening tool. A stop is formed at the end of the track to prevent the support foot from traveling past a desired location on the fastening tool.

To removably attach the support foot to a fastening tool, the operator need only move the support foot toward the fastening tool until an upper surface of the support foot engages a lower surface of the fastening tool. Then the operator moves the support foot along the lower surface of the fastening tool until the leading edges of the support foot proximate open ends of the channels engage the tracks. The operator then slides the support foot along the tracks until the leading edges are deflected away from respective male detents on the tracks. The operator continues to push the support foot along the tracks until the male detents become nested in the female detents. The support foot is thus releasably but securely retained at the location of the male detents, having never required the use of any tools during the entire process. (It should be noted that in this respect, if desired, the tracks can be constructed of a plastic material so that they deflect away from the leading edge of the support foot, rather than vice-versa.)

To remove the support foot, the operator need only push the support foot in the reverse direction along the tracks so that the respective detents separate, and until the support foot channels clear the tracks. Then, again without using any tools, the operator simply moves the support foot away from the fastening tool lower surface.

The support foot and fastening tool provide a fail-safe method for preventing the support foot from being attached to the fastening tool backwards, namely at an orientation other than the desired orientation of the support foot relative to the fastening tool. The channels or slots provided in the upper surface of the support foot define respective open and closed ends. If an operator moves the support foot oriented backwards so that it engages the lower surface of the fastening tool, and then attempts to engage the tracks with the support member, the closed end of the support member blocks any further movement along the lower surface of the fastening tool. Thus, the only way the support member can be attached to the tracks disposed on the fastening tool is by orienting the support member correctly relative to the fastening tool.

In another embodiment of the fastening tool of the present invention, the underside of the fastening tool or of the magazine, as the case may be, is provided with a plurality of detents on each track, corresponding to a plurality of locations along the track at which it is desired to retain the support member.

In this connection, yet another feature of the support member and fastening tool allows an operator, without using any tools, to compensate for changes in height of the contact trip occasioned by using an adjustable contact trip mechanism. If, for example, the contact trip were to be adjusted to be higher, then the contact trip drive axis would become skewed from the desired angle relative to a work surface. In the case of a concrete nailer, it is highly desirable to maintain that angle as close to 90° as possible. Accordingly, when using a mechanism to adjust the height of the contact trip (as, for example, when using differently-sized nails), the support member can simply be moved by hand from one position on the tracks determined by the location of one set of male detents, to another position determined, for example, by another set of male detents, until the support foot contacts the work surface at a location where the drive axis is once again perpendicular to the work surface.

The present invention accordingly yields a fastening tool and support foot fulfilling the need for an inexpensive, one-piece support member that can be quickly and easily attached to, and securely retained on, a fastening tool or magazine, and then quickly and easily removed, without using any tools.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the present invention, and such exemplifications are not to be construed as limiting the scope of the present invention in any manner.

DETAILED DESCRIPTION OF THE INVENTION

Figure 1:
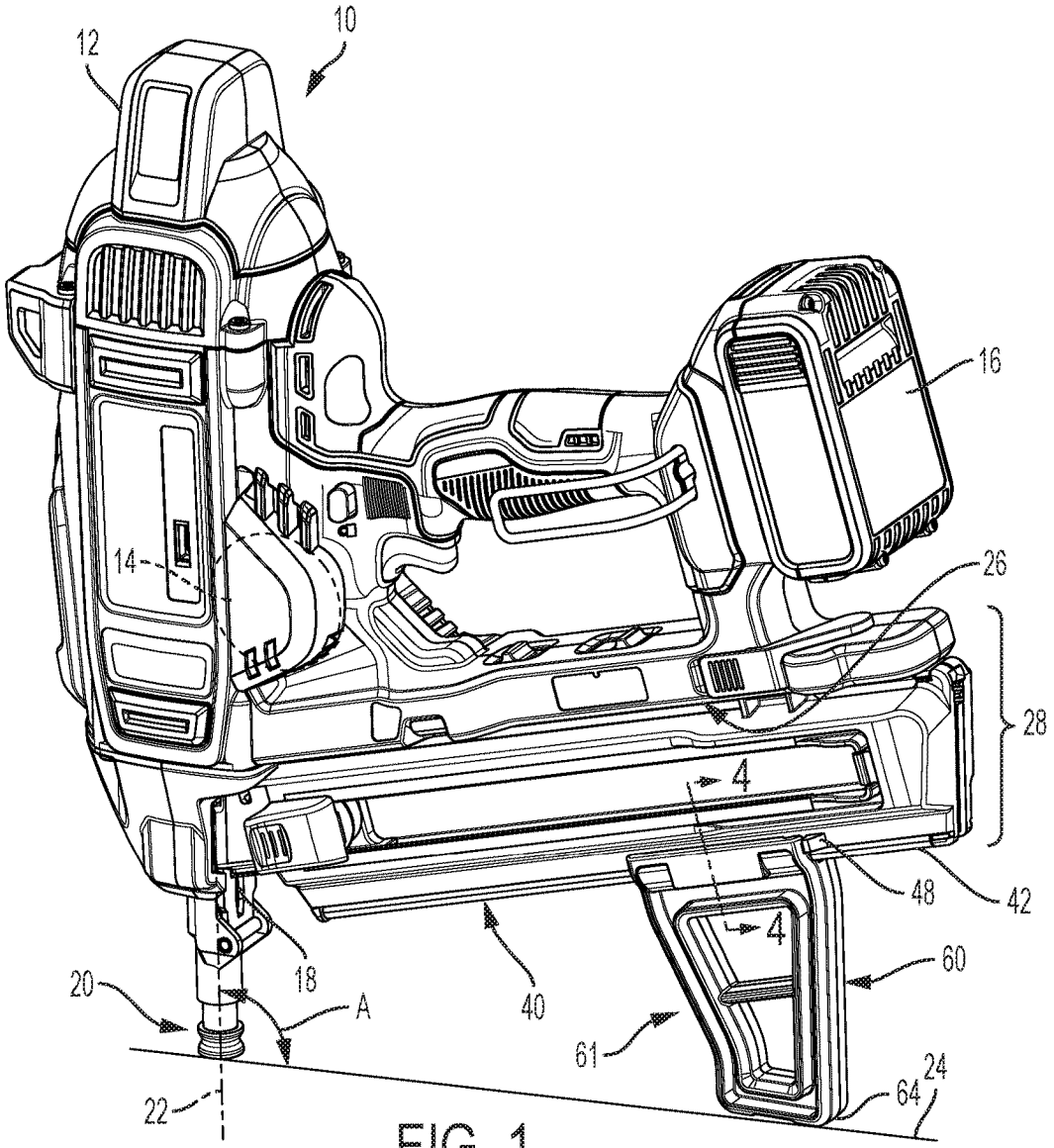
FIG. 1 is a perspective view of one embodiment of a fastening tool and support foot of the present invention.

Referring now to the drawings and particularly to FIG. 1, a fastening tool 10 in accordance with an embodiment of the present invention includes a housing 12, a motor 14 (shown in phantom) disposed in the housing, a battery pack 16 for providing power to the motor, and a drive system including a drive bar (not shown) configured for driving a fastener and being operatively associated with the motor, such as, for example, by use of a flywheel. The drive system further includes a drive track 18 and a contact trip 20, disposed along a drive axis 22, which is oriented at a desired angle A relative to a work surface 24.

Figure 12:
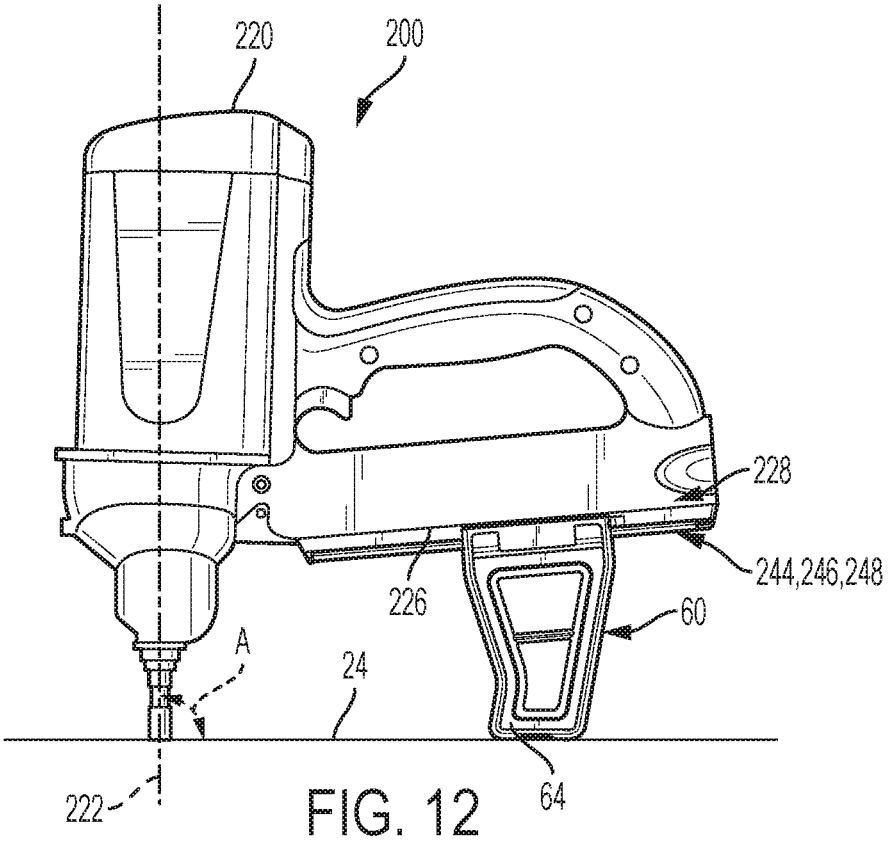
FIG. 12 shows another embodiment of a fastening tool and support foot of the present invention, in which the support foot is mounted directly upon a lower surface of the fastening tool housing.

Continuing to refer to FIG. 1, a fastener magazine 40 is attached to an underside 26 of the housing 12, and a support member or foot 60 of the present invention is removably attached to the magazine. Although the fastening tool 10 is depicted as having a magazine 40 to which the support foot 60 is attached, it is important to note that the support foot may also be directly attached to the underside 26 of the fastening tool, in the event the fastening tool does not have a magazine, or in the event that the fastening tool magazine is disposed in a location on the housing 12 other than at the underside. Such an embodiment of the fastening tool 200 is shown in FIG. 12. Consequently, for the purposes of this description, a "lower surface" 28 of the fastening tool 10 is defined generally to include not only the underside 26 of housing 12, but also to include the magazine 40, so that it can be seen that the support foot 60 is readily usable with either type of fastening tool (see bracketed region 28 in FIG. 1).

As is also shown in FIG. 1, one purpose of the support foot 60 is to maintain a desired orientation of the fastening tool drive axis 22 at an angle A with a work surface 24. Accordingly, it should also be noted that, although an embodiment of the present invention is described in connection with an electric-powered concrete nailer, the magazine 40 and support foot 60 may be used with any type of fastening tool, including without limitation staplers and other nailers. Furthermore, such fastening tools may use other types of drive systems, including without limitation hydraulic, pneumatic, combustion/gas, and explosive/powder-actuated systems. Therefore, regardless of the type of fastening tool, the magazine 40 and support foot 60 will be operative to maintain the desired orientation at an angle A.

Figure 2:
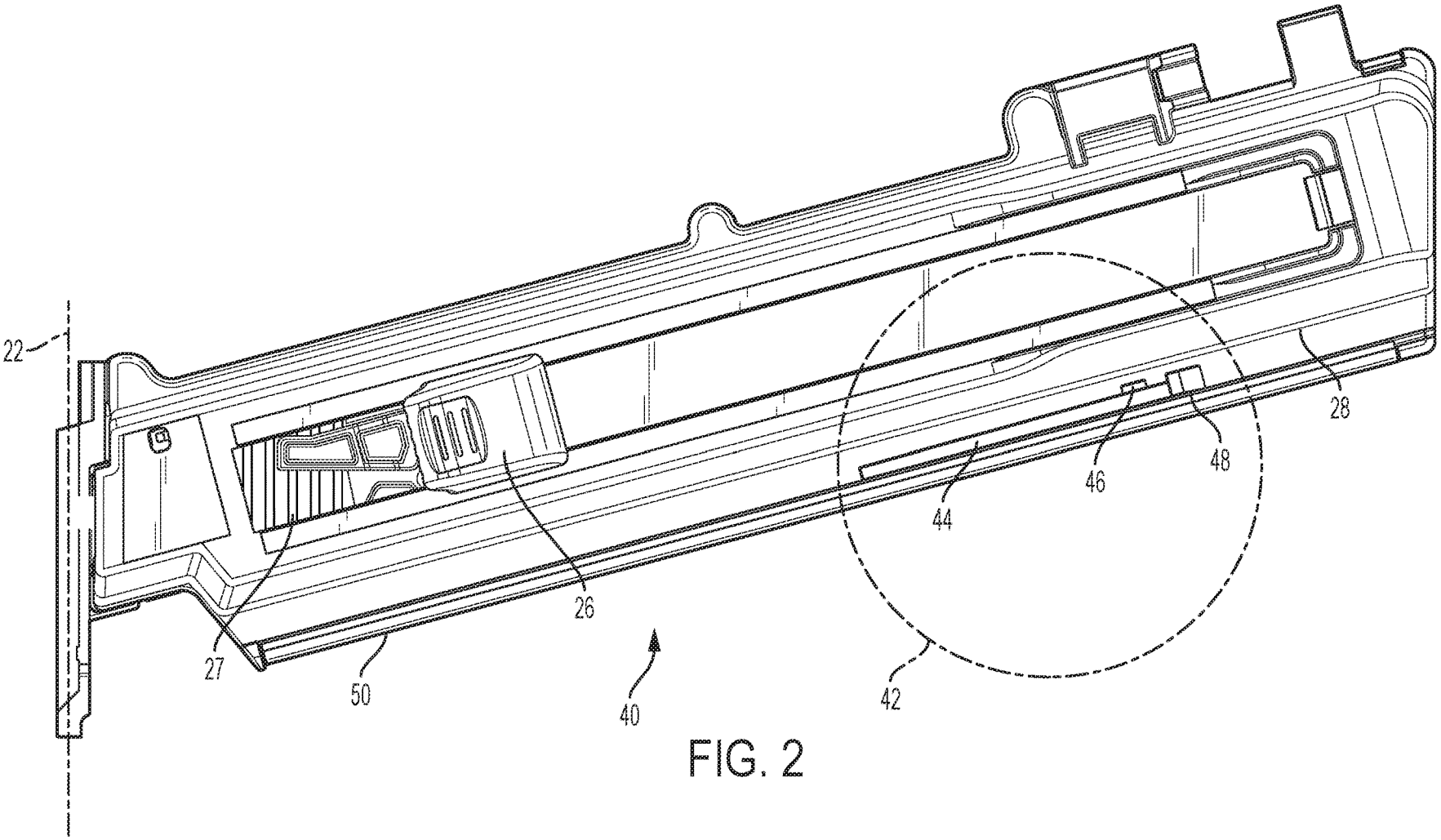
FIG. 2 is an enlarged elevational detail view of a magazine of the fastening tool of FIG. 1.
Figure 3:
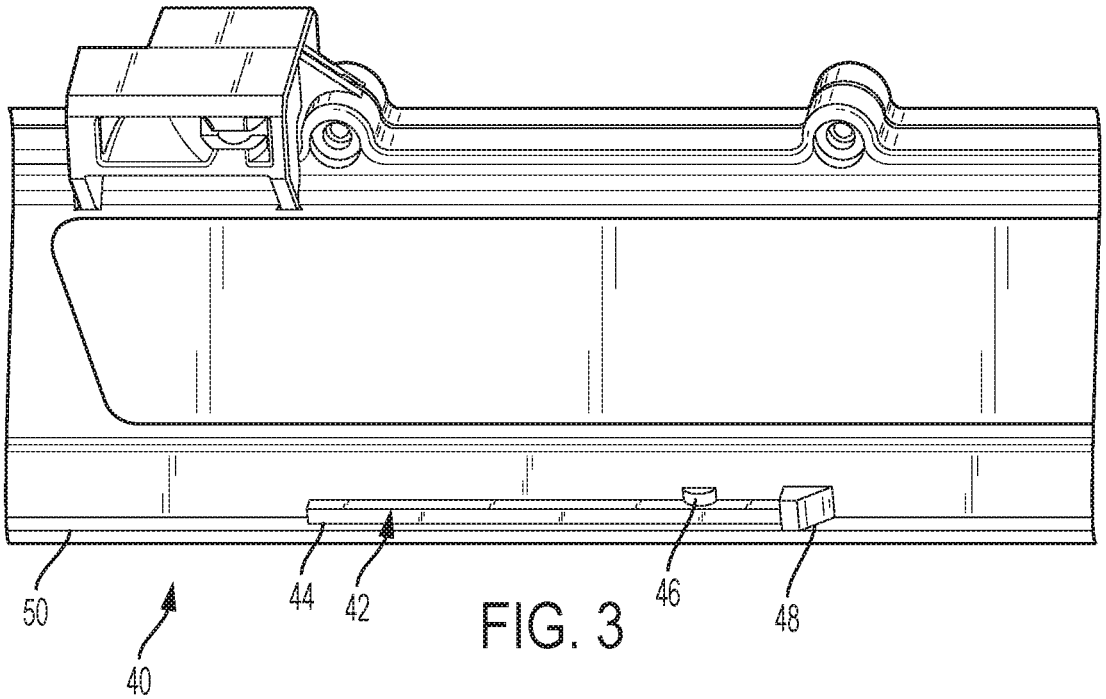
FIG. 3 is a detail of the circled region of FIG. 2.
Figure 4:
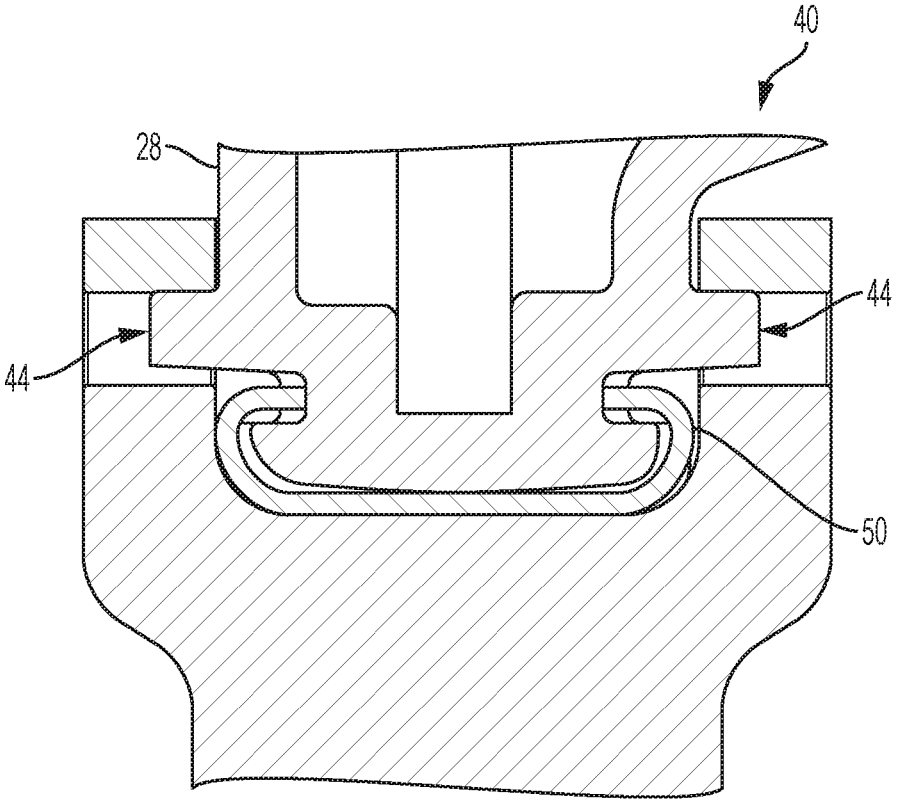
FIG. 4 is an enlarged partial elevational sectional view taken along line 4-4 of FIG. 1.

Now referring to FIGS. 1-3, the magazine 40 is configured to hold nails 27 oriented in parallel with the drive axis 22, and defines an engagement portion 42 of the lower surface 28 that cooperates with the support foot 60 to retain the support foot on the fastening tool 10. The engagement portion 42 includes a track 44 disposed on each side of the magazine 40, each track defining a male detent 46 and a stop 48. As shown in FIG. 4, magazine 40 is also equipped with a retaining guard 50.

FIG. 1 shows the support foot 60 disposed on the track 44 so that the support foot engages the stop 48. At this location of the support foot 60 on the lower surface 28, various elements of the support foot and the magazine 40 cooperate to releasably retain the support foot in the position shown in FIG. 1. This cooperation maintains the orientation of the fastening tool drive axis 22 at the angle A relative to work surface 24.

Figures 5A, 5B, 5C, 5D, 5E, 5F, 5G:
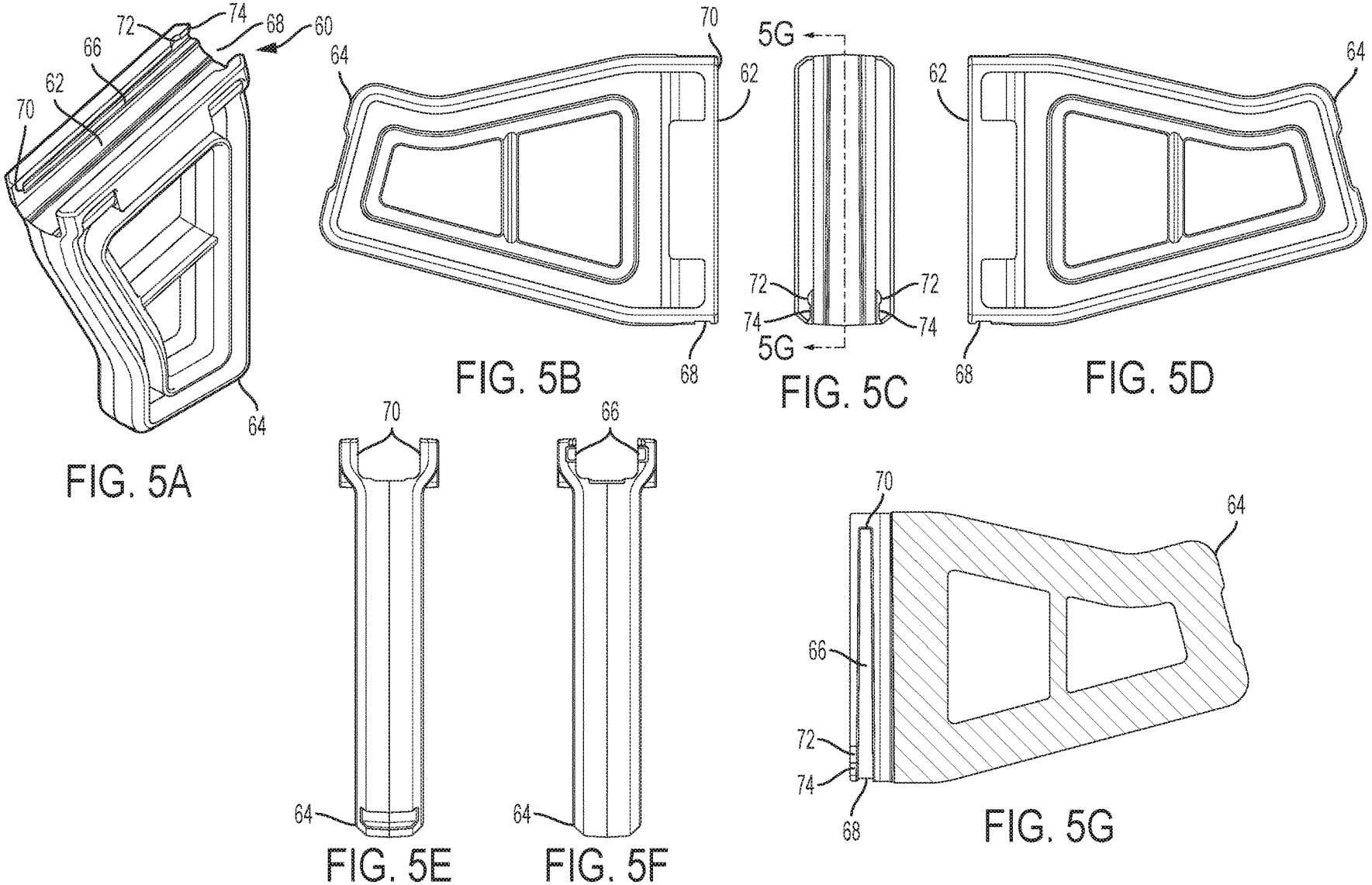
FIG. 5A is a perspective detail view of the support foot of the present invention.
FIGS. 5B and 5D are side elevational views of the support foot of FIG. 5A.
FIG. 5C is a top plan view of the support foot of FIG. 5A.
FIGS. 5E and 5F are elevational views taken from the rear and the front, respectively, of the support foot of FIG. 5A.
FIG. 5G is an elevational sectional view taken along line 5G-5G of FIG. 5C.

FIGS. 5A-5G detail the features of the support foot 60, which defines an upper surface 62 and a work surface-engaging portion 64 disposed at the bottom of the support foot. The upper surface 62 in turn defines two opposed parallel slots or channels 66, each having an open front end 68 and a closed rear end 70 (FIG. 5G). The upper surface 62 further defines two opposed female detents 72 and a leading edge 74. In one embodiment of the support foot 60, the support foot is manufactured from glass-filled nylon so that the support foot has a slight amount of resiliency.

Figure 6B:
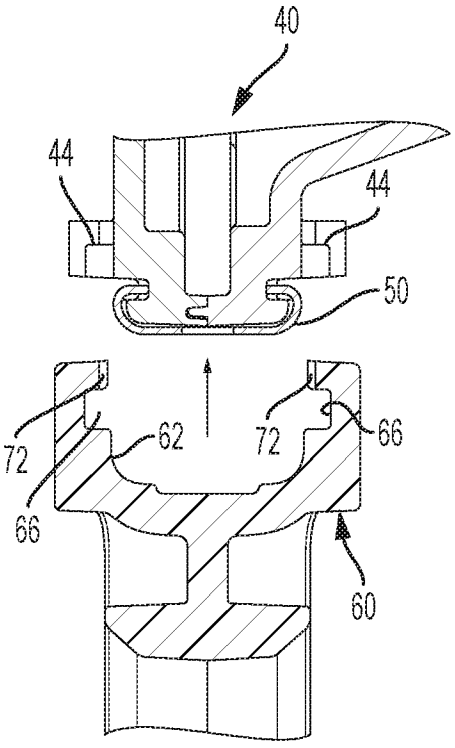
FIG. 6B is an elevational sectional detail view taken along line 6B-6B of FIG. 6A.
Figure 6A:
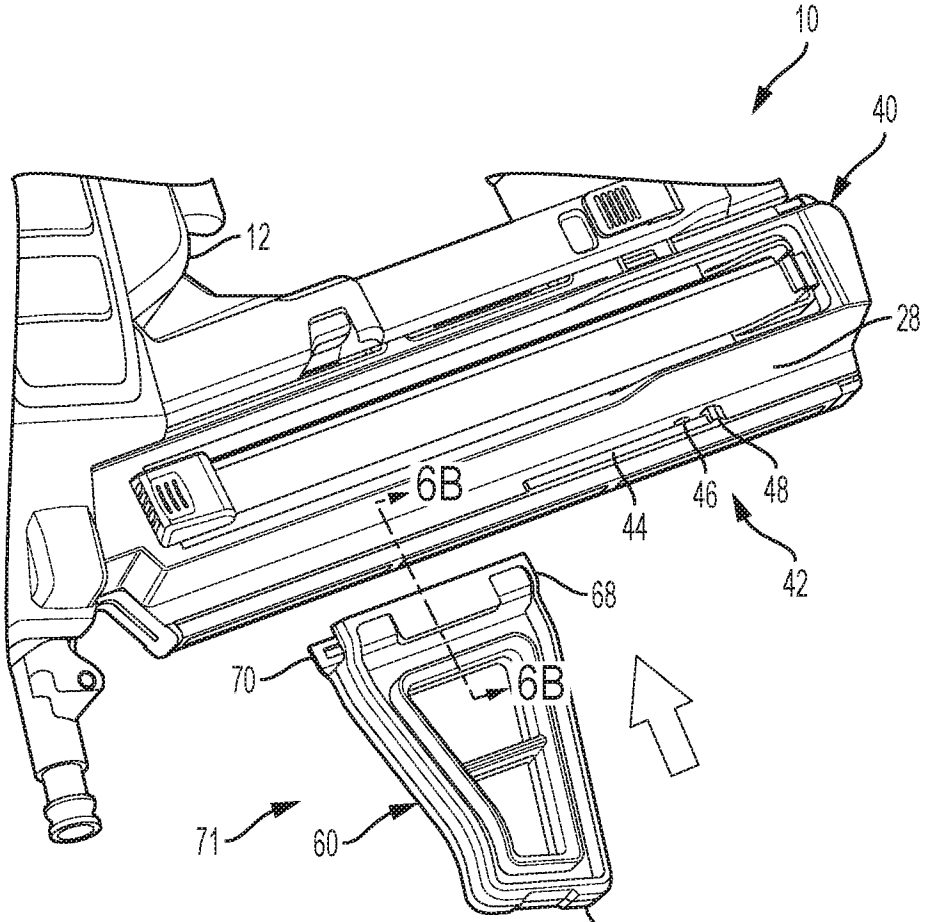
FIG. 6A is a partial exploded perspective view of the fastening tool and support foot of FIG. 1, showing an upper surface of the support foot being moved toward a lower surface of the fastening tool.
Figure 7B:
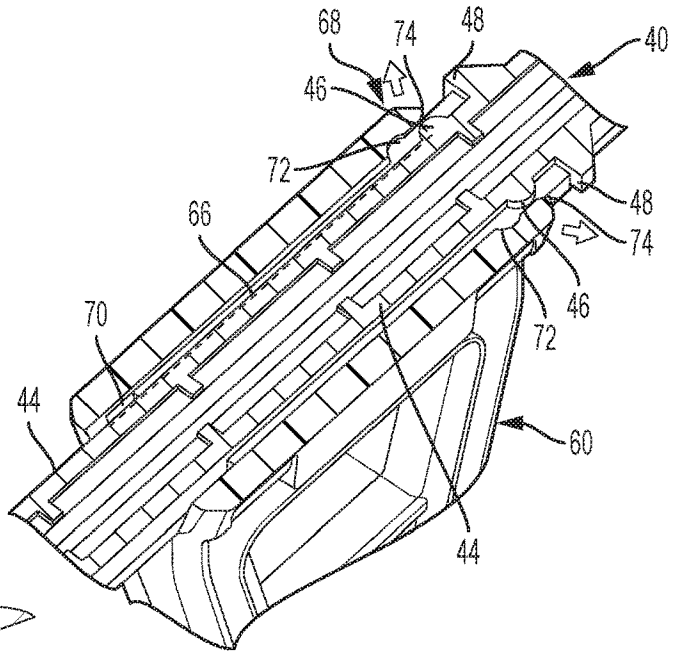
FIG. 7B is a horizontal sectional detail view taken along line 7B-7B of FIG. 7A.
Figure 7C:
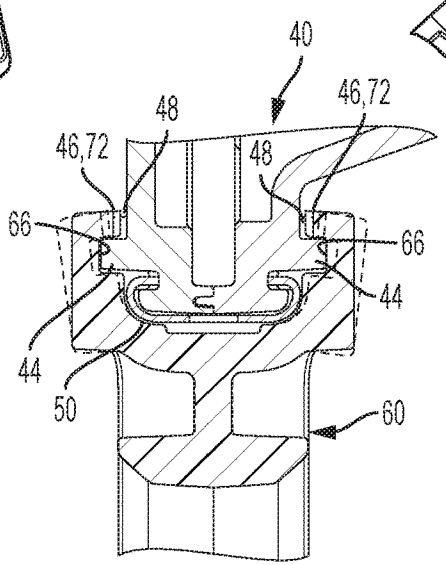
FIG. 7C is a view similar to that of FIG. 6B, taken along line 7C-7C of FIG. 7A.
Figure 7A:
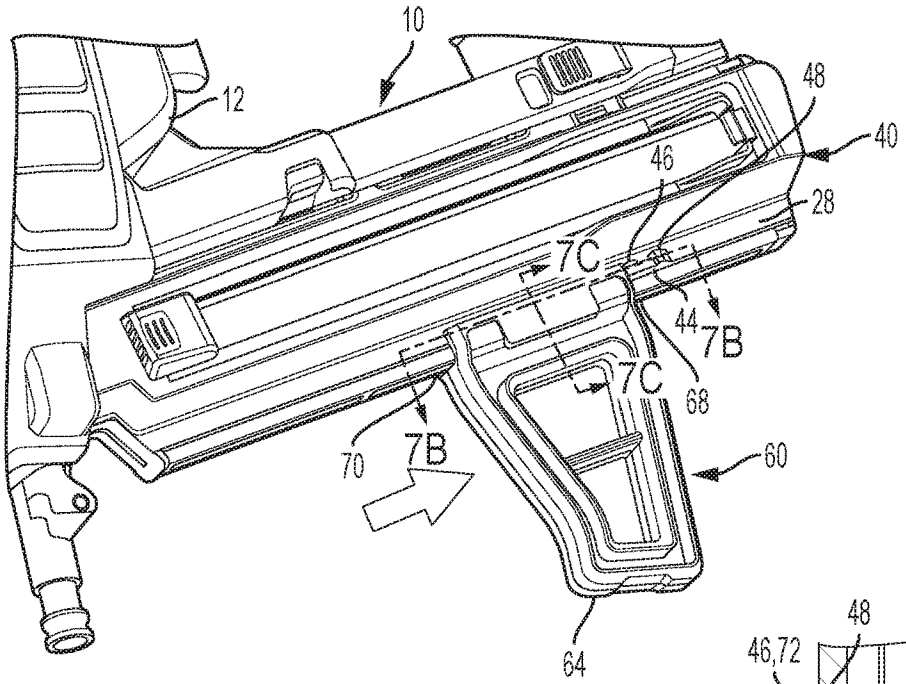
FIG. 7A is a view similar to that of FIG. 6A, showing the support foot being moved along tracks of the fastening tool so that leading edges of the support foot begin to deflect away from male detents formed on the tracks.

A method of releasably attaching the support foot 60 to the lower surface 28 of the fastening tool 10 is illustrated in FIGS. 6A through 8C. The support foot 60, oriented at a desired orientation 71 relative to the fastening tool 10, is moved toward the magazine 40, as shown in FIGS. 6A and 6B, so that the upper surface 62 of the support foot engages the lower surface 28 of the fastening tool. Then, as shown particularly in FIG. 7A, the support foot 60 is moved along the lower surface 28 until respective channels or slots 66 in the support foot engage corresponding tracks 44 on the lower surface. The fastening tool operator continues to move the support foot 60 in the direction shown by the arrow in FIG. 7A until male detents 46 cause the leading edges 74 of the support foot to deflect slightly away from the male detents 46, as shown by the arrows in FIG. 7B, and by the phantom line positions of the support foot in FIG. 7C.

Figure 8B:
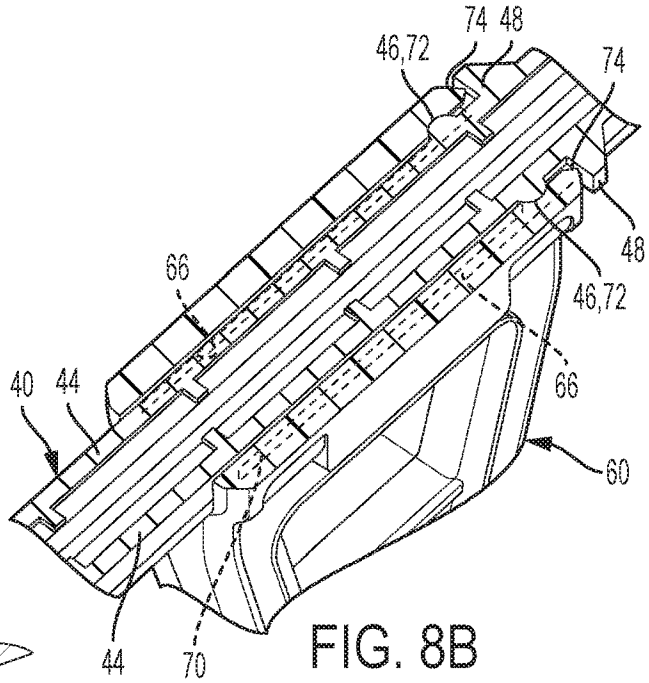
FIGS. 8B and 8C are views similar to those of FIGS. 7B and 7C, respectively, but showing the support foot positioned as shown in FIG. 8A.
Figure 8C:
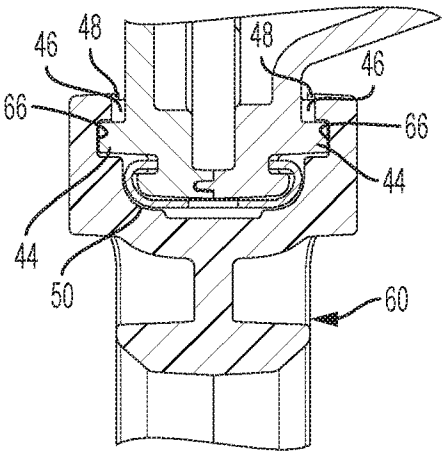
Figure 8A:
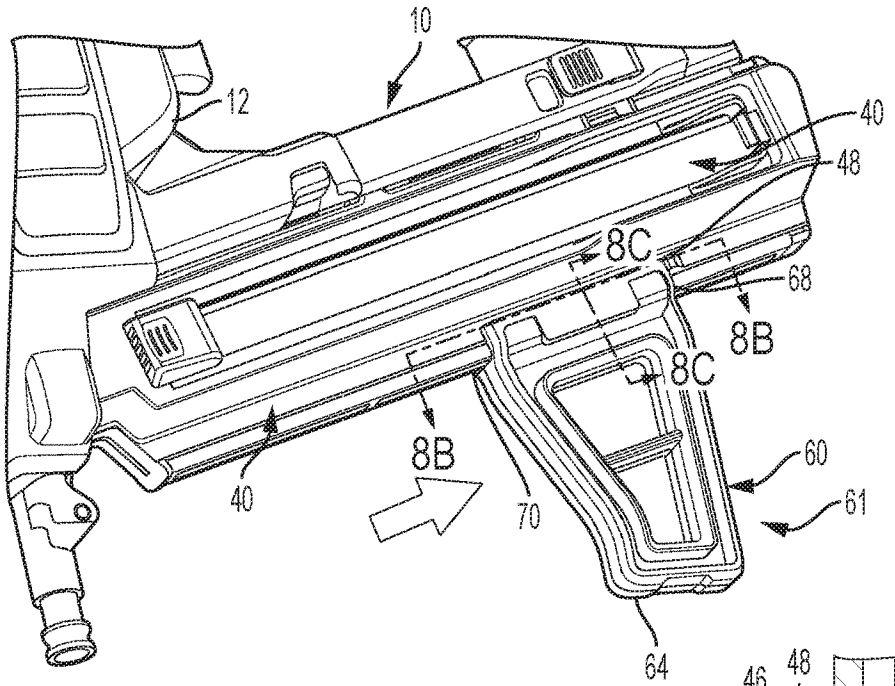
FIG. 8A is a view similar to that of FIG. 7A and showing the support foot having been moved on the tracks to a position where respective detents cooperate to retain the support foot in place.
Figure 9C:
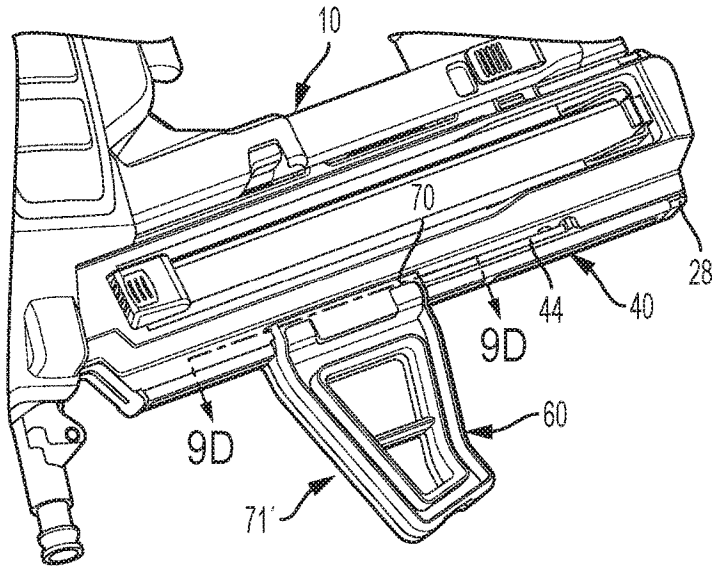
FIG. 9C is a view similar to that of FIG. 9A, but showing the support foot being blocked from traveling along the tracks.
Figure 9D:
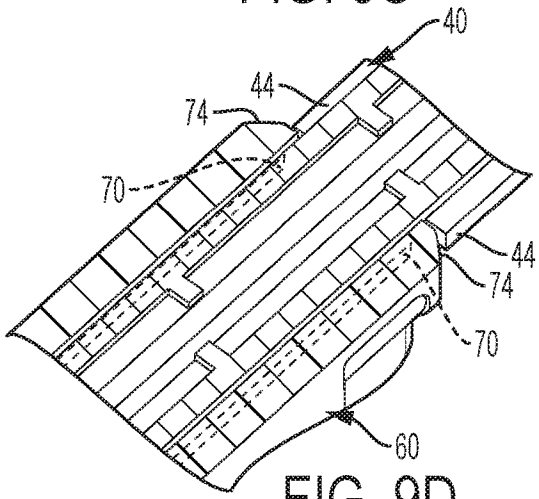
FIG. 9D is a horizontal sectional detail view taken along line 9D-9D of FIG. 9C.
Figure 9A:
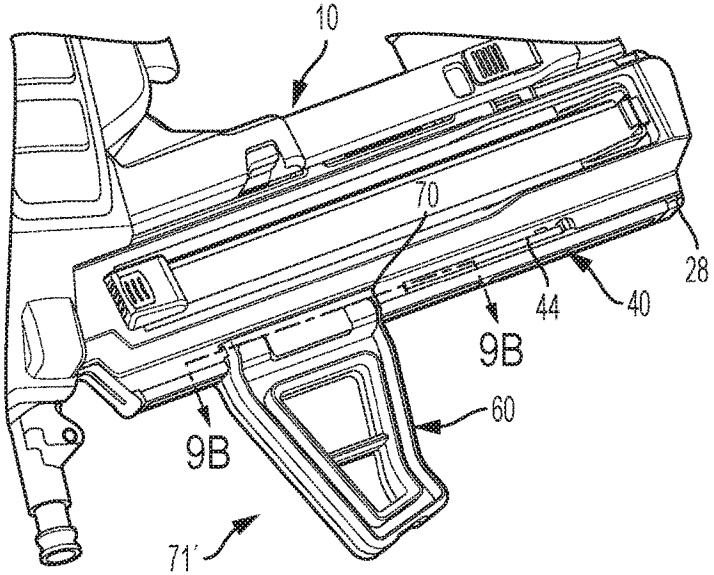
FIG. 9A is a partial perspective detail view of a support foot positioned on the lower surface of the fastening tool of FIG. 1, but oriented at an incorrect orientation relative to the fastening tool.
Figure 9B:
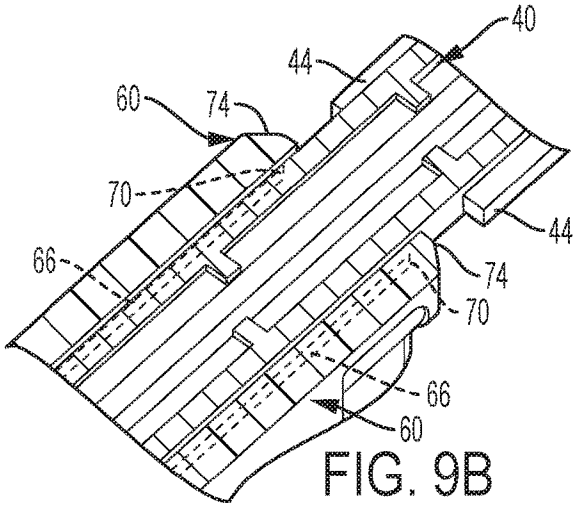
FIG. 9B is a horizontal sectional detail view taken along line 9B-9B of FIG. 9A.

As shown in FIGS. 8A through 8C, the fastening tool operator continues to slide the support foot 60 along the track 44 until respective male detents 46 become nested in their corresponding female detents 72. Stops 48 may also engage respective leading edges 74 of the support foot 60 to prevent the support foot from traveling past the position shown in FIG. 8B. It should be noted that, in one embodiment of the present invention, the magazine 40 is manufactured from glass-filled polypropylene. Consequently the process depicted so far shows the support foot 60 deflecting away from detents 46 formed on the magazine 40. However, if desired, the magazine can be manufactured so that a portion of the magazine, namely, the male detents 46, deflect inwardly away from the leading edges 74 of the support foot, instead. In this case, for example, the magazine detents may be formed of a suitable plastic such as DELRIN® plastic, or nylon without glass fill.

The support foot 60 is prevented from being attached to the lower surface 28 backwards. In this event, when the support foot 60 is positioned against magazine 40 at an incorrect orientation 71', as illustrated in FIGS. 9A-9D, such that the closed rear end 70 of the support foot is placed closer to the tracks 44 than the open front end 68 of the support foot, the closed front end is blocked by the tracks (see FIGS. 9B and 9D). This prevents the support foot 60 from being moved along the tracks 44, and thus prevents the support foot from being attached to the lower surface 26 of the fastening tool 10 at the incorrect orientation 71' (namely, backwards).

Figure 10A:
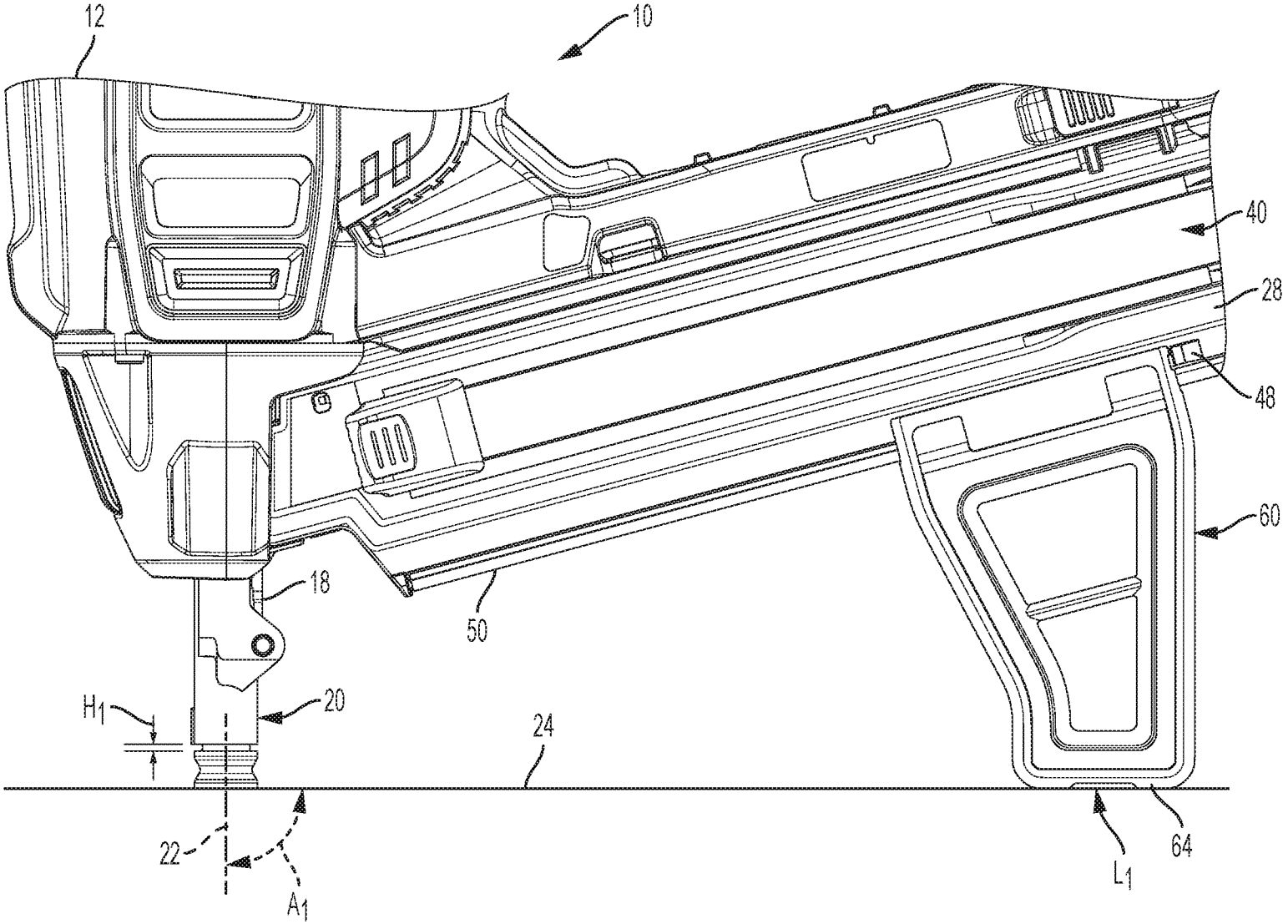
FIG. 10A is a partial elevational detail view of the fastening tool and support foot of FIG. 1, where the contact trip has a height H1.
Figure 10B:
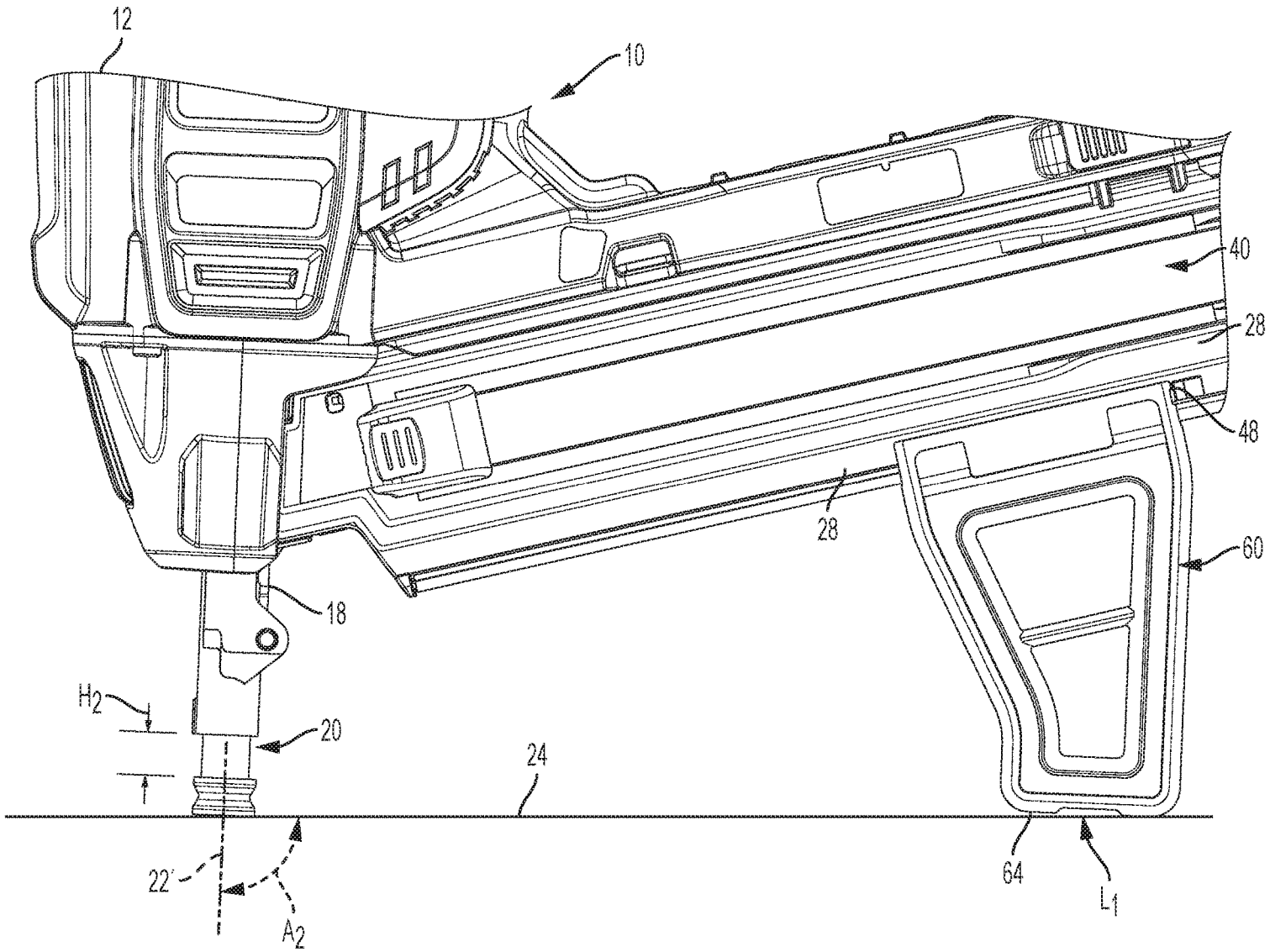
FIG. 10B is a view similar to that of FIG. 10A, but where the contact trip height has been increased to H2.
Figure 10C:
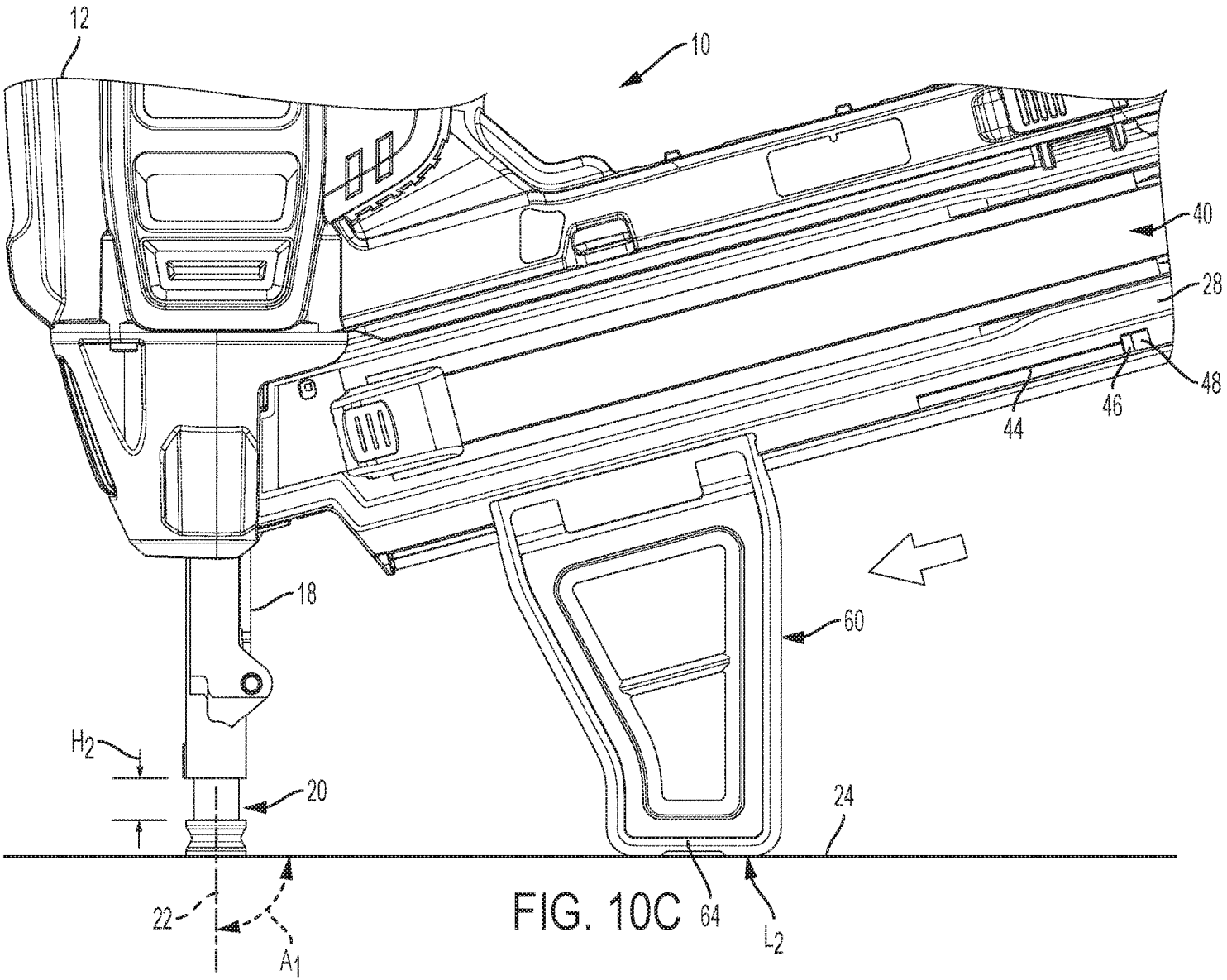
FIG. 10C is a view similar to that of FIG. 10B, showing that the support foot has been positioned on the fastening tool of FIG. 1 to compensate for the change in height of the contact trip.

FIGS. 10A-10C illustrate a method for compensating for the use of a height-adjustment system to change the height of the contact trip 20 relative to the work surface 24. FIG. 10A shows the angle A1 of the drive axis 22 when the height of the contact trip is set at H1, and when the location of the work surface-engaging portion 64 of the support foot 60 is at L1. If the contact trip height is increased to H2, as shown in FIG. 10B, the drive axis 22' becomes skewed to form a different angle A2 relative to the work surface 24. Also, a portion of the work surface-engaging portion 64 is lifted slightly off the work surface 24. To compensate for the increase in contact trip height, and to bring the angle of the drive axis 22' relative to the work surface 24 back to angle A1, the fastening tool operator merely moves the support foot 60 by hand along the tracks 44 in a first direction shown by the arrow in FIG. 10C, until the respective male and female detents 46, 72 are disengaged. The operator then continues to move the support foot 60 along the lower surface 28 until the support foot reaches a location L2 where the work surface-engaging portion 64 of the support foot engages the work surface 24, such that the drive axis 22 is oriented once again at angle A1.

Figure 11B:
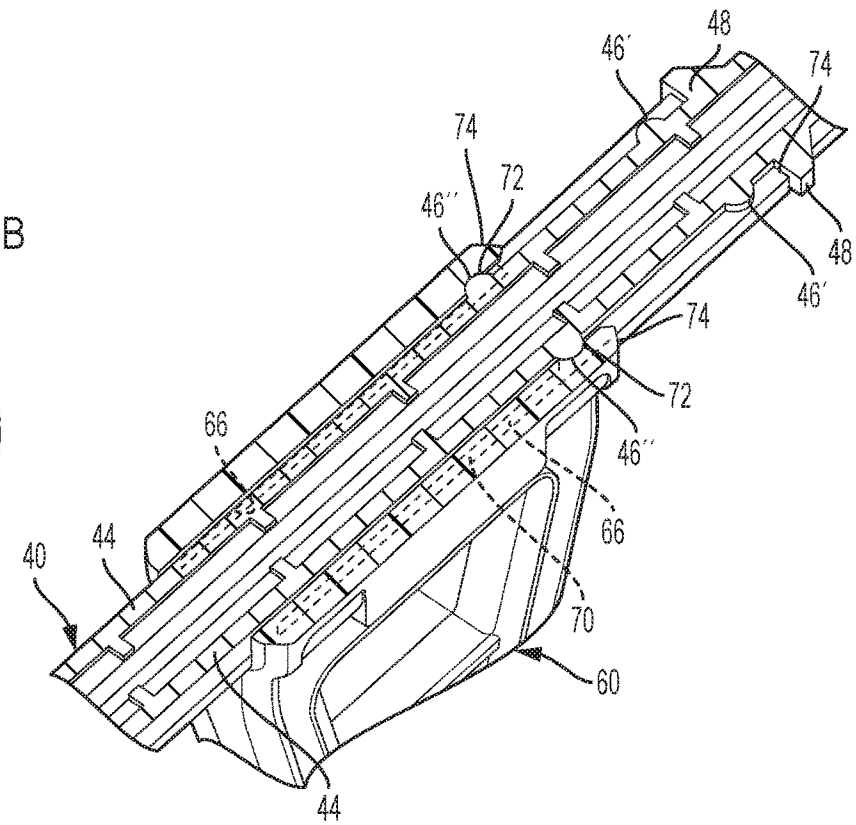
FIG. 11B is a horizontal sectional view taken along the line 11B-11B of FIG. 11A, but showing the support foot attached to the fastening tool.
Figure 11A:
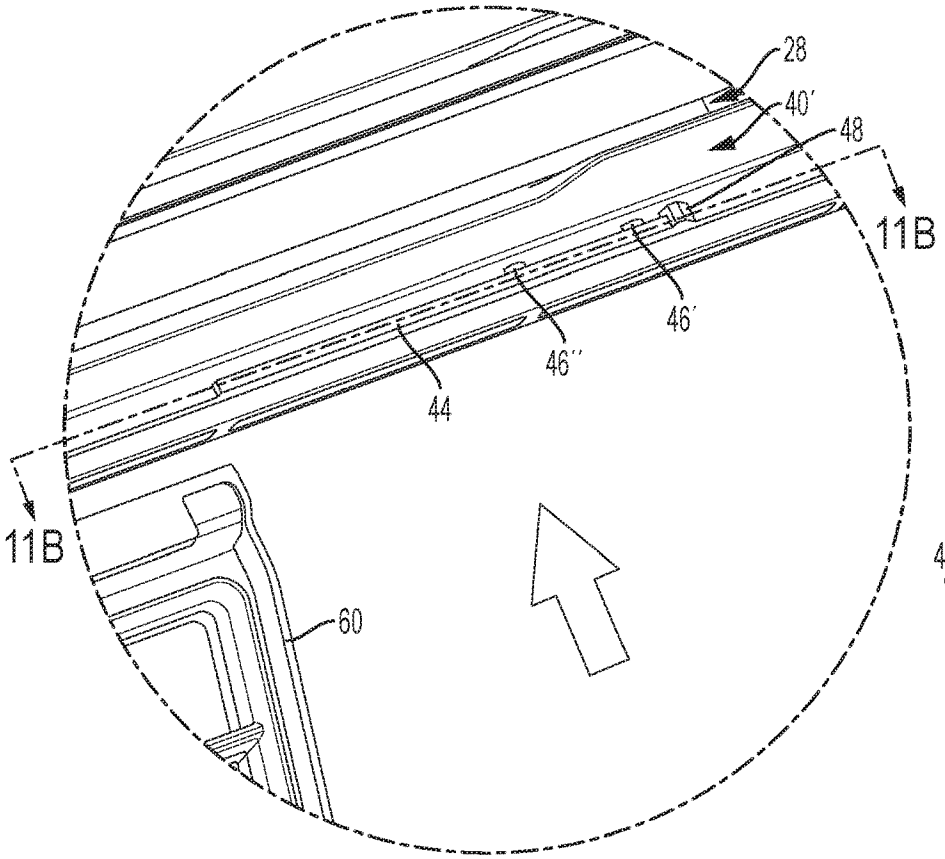
FIG. 11A is an enlarged elevational detail view of the lower surface of a second embodiment of the fastening tool of the present invention.

If it is desired to retain the support foot 60 at the position shown, for example, in FIG. 10C, the lower surface 28 of the fastening tool 10 may be modified as shown in FIGS. 11A and 11B. Here the magazine 40' now defines first and second male detents 46', 46" which cooperate with the female detents 72 of the support foot 60, in the same manner as is shown in FIG. 8B when a single set of male detents 46 are used, so that the support foot can be retained at two different locations relative to the fastening tool 10. Using no tools, the operator merely moves the support foot 60 as shown by the arrow in FIG. 11A so that the support foot engages the lower surface 28 (in this case, of magazine 40'), then moves the support foot along the lower surface until the support foot engages the track 44, as was previously described. The operator then slides the support foot 60 along the track 44 until the support foot is retained in place either by male detents 46' or by male detents 46". To remove the support foot 60, the operator simply reverses the process. The operator, using hand pressure only, simply slides support foot 60 in the opposite direction along the tracks 44 until the support foot is disengaged from the male detents 46', 46". Then, the operator continues to move the support foot 60 until the support foot clears the tracks 44. At that point, all the operator has to do is move the support foot 60 away from the lower surface 28 of the fastening tool 10. Of course, if desired, more than two detents 46 may be used.

The support foot 60 may also be mounted directly to a lower surface 228 of another embodiment of the fastening tool 200 of the present invention, as shown in FIG. 12. Here, fastening tool 200 includes a housing 220 which defines an underside 226, upon which are formed tracks 244, detents 246, and stops 248, which are configured similarly to their respective counterparts 44, 46 and 48 previously described. The support foot 60 thus similarly maintains a drive axis 222 oriented at a desired angle A relative to the work surface 24.

It can now be seen that various embodiments of the fastening tool, magazine and support foot of the present invention fulfill the need for an inexpensive system for easily but securely attaching a support foot to a fastening tool, so that the support foot can be removably retained at a desired location on the fastening tool, all without the use of any tools whatsoever.

While the present invention has been described with respect to various embodiments, the present invention may be further modified within the spirit and scope of this disclosure. This application is therefore intended to cover any variations, uses, or adaptations of the present invention using its general principles. Further, this application is intended to cover such departures from the present disclosure as come within known or customary practice in the art to which this invention pertains and which fall within the limitations of the appended claims.

What is claimed is:

1. A fastening tool, comprising:

a housing having an underside;

a fastener drive system disposed in the housing, the fastener drive system including a drive track disposed along a drive axis;

a magazine containing fasteners, the magazine connected to the housing and configured to present fasteners to the drive track to be driven by the drive system into a work surface;

a pair of tracks disposed in parallel on opposite lateral sides on one of the underside and the magazine between the drive axis and a fixed stop member on each track; and a support member having an upper surface defining slots arranged in parallel that engage one of the underside and the magazine, the support member formed of a single unitary body having a detent portion that, in a first position of engagement with one of the underside and the magazine, deflects away from the pair of tracks, and in a second position of engagement with one of the underside and the magazine, deflects toward and engages the pair of tracks to releasably secure the support member to one of the underside and the magazine, the support member being repositionable along the pair of tracks to maintain a desired angle of the drive axis relative to the work surface, wherein at least one of the underside-and the magazine is deformable upon contact with the slots arranged in parallel to retain the support member in a desired position, and wherein the slots arranged in parallel are deformable upon contact with one of the underside and the magazine, to retain the support member in the desired position.

2. The fastening tool claimed in claim 1, wherein the support member is retained in the desired position, tool free.

3. The fastening tool claimed in claim 1, wherein the slots are engageable with respective tracks, and wherein the support member is slidable along the tracks.

4. The fastening tool claimed in claim 3, wherein the tracks and slots define respective cooperating detents such that the support member may be retained at a desired position on the tracks.

5. The fastening tool claimed in claim 4, wherein each track defines a plurality of male detents, wherein each slot defines a plurality of female detents cooperating with respective male detents, and wherein the support member may be retained at a plurality of desired positions on the tracks corresponding to the respective positions of the plurality of male detents.

6. The fastening tool claimed in claim 4, wherein the fixed stop member is formed at one end of each track to limit the distance that the support member may be moved along the tracks.

7. The fastening tool claimed in claim 4, wherein each slot defines an open front end and a closed rear end such that the support member is blocked from moving along the tracks by the closed rear end when the support member engages the fastening tool with the closed rear end closer to the tracks than the open front end.

8. The fastening tool claimed in claim 1, wherein the upper surface further defines a leading edge of the support member, and wherein the leading edge deflects to increase the distance between the slots arranged in parallel when the support member is releasably secured to one of the underside and the magazine.

9. A fastening tool, comprising:

a housing having an underside defined between the fastening tool and a work surface;

a fastener drive system disposed in the housing, the fastener drive system including a drive track disposed along a drive axis;

a magazine containing fasteners, the magazine connected to the housing and configured to present fasteners to the drive track to be driven by the drive system into a work surface;

a pair of tracks disposed in parallel on opposite lateral sides on one of the underside and the magazine between the drive axis and a fixed stop member on each track;

at least one detent on one of the underside and the magazine; and a support member formed of a single unitary body having a tool engaging portion defined by slots arranged in parallel having at least one support member detent that engages the at least one detent on one of the underside and the magazine to releasably secure the support member thereto, the support member being repositionable along the pair of tracks to maintain a desired angle of the drive axis relative to the work surface, wherein at least one of:

the at least one detent on one of the underside and the magazine is deformable against the support member detent, to retain the support member in the desired position, and the at least one support member detent is deformable against the at least one detent on one of the underside and the magazine, to retain the support member in the desired position.

10. The fastening tool claimed in claim 9, wherein the fixed stop member is formed at one end of each track to limit the distance that the support member may be moved along the tracks.

11. The fastening tool claimed in claim 9, wherein each slot defines an open front end and a closed rear end such that the support member is blocked from moving along the tracks by the closed rear end when the support member engages the fastening tool with the closed rear end closer to the tracks than the open front end.

12. The fastening tool claimed in claim 9, wherein the support member includes an upper surface that further defines a leading edge of the support member, and wherein the leading edge deflects to increase the distance between the slots arranged in parallel when the support member is releasably secured to one of the underside and the magazine.

* * * * *